United States Patent [19]

Lawrence

[11] 4,324,060

[45] Apr. 13, 1982

[54] FIREARM SYSTEM

[76] Inventor: George L. Lawrence, 517 W. 160th St., New York, N.Y. 10032

[21] Appl. No.: 131,271

[22] Filed: Mar. 17, 1980

[51] Int. Cl.[3] ..... F41C 19/12; F42B 5/08

[52] U.S. Cl. ..... 42/84; 102/202.9; 102/472

[58] Field of Search ..... 42/84; 102/472, 202.5, 102/202.8, 202.9; 89/28 R

[56] References Cited

U.S. PATENT DOCUMENTS

| | | | |
|---|---|---|---|
| 291,288 | 1/1884 | Brown | 42/84 |
| 815,490 | 3/1906 | Thomas | 42/84 |
| 937,396 | 10/1909 | Venier | 42/84 |
| 1,076,530 | 10/1913 | Tepins | 42/84 |
| 1,239,344 | 9/1917 | Bowman et al. | 42/84 |
| 2,780,882 | 2/1957 | Temple | 42/84 |
| 2,978,827 | 4/1961 | Rouby | 42/84 |
| 3,250,034 | 5/1966 | Simmons | 42/84 |
| 3,255,547 | 6/1966 | Gregory, Jr. | 42/84 |
| 3,453,764 | 7/1969 | Grolleau | 42/84 |
| 3,613,282 | 10/1971 | Ramsay | 42/84 |
| 3,650,174 | 3/1972 | Nelsen | 42/84 |

*Primary Examiner*—Charles T. Jordan

[57] ABSTRACT

A firearm system including a shell having an electrically conductive contact disposed axially of a shell insulator having a rearwardly facing curved surface, the shell insulator being disposed centrally of a metal jacket portion of the shell, the first end of the shell contact being exposed at the rearwardly facing surface of the shell insulator and a second end of the shell contact extending inwardly of the shell and in contact with a reservoir of powder; and a firearm comprising a housing having a chamber for receiving the shell, an electrical circuit mounted in the housing and including a contact mounted in a chamber insulator having a forwardly facing surface complementary to the shell insulator, the chamber insulator being disposed in the chamber and adapted for engagement with the shell insulator, to place the shell contact in engagement with the chamber contact, a power source disposed in the circuit, and a trigger mounted on the housing and movable by an operator to close the circuit whereby to place the power source in electrical communication with the shell contact to ignite the powder in the shell.

7 Claims, 5 Drawing Figures

FIREARM SYSTEM

BACKGROUND OF THE INVENTION

1. Field of the Invention

This invention relates to firearm systems and is directed more particularly to an electrically operated firearm system.

2. Description of the Prior Art

Firearms having electrical firing mechanisms and shells adapted therefor are generally known in the art. U.S. Pat. No. 815,490, issued Mar. 20, 1906 to M. E. Thomas shows a firearm having an electrical power source therein, and a trigger means for closing an electrical circuit to conduct electricity to a shell having an electrical contact therein, the contact being adapted to fire a reservoir of powder in the shell. U.S. Pat. No. 937,396, issued Oct. 19, 1909 to W. Venier shows an electrical ignition system for firearms having more than one firing chamber. U.S. Pat. No. 1,076,530, issued Oct. 21, 1913 to A. Tepins discloses a safety system for an electrically operated firearm. U.S. Pat. No. 2,780,882, issued Feb. 12, 1957 to L. M. Temple shows an electrically operated firearm featuring a movable firing plunger. In U.S. Pat. No. 2,978,827, issued Apr. 11, 1961 to C. Rouby a conductive rod is spring-biased against a shell primer to insure contact. In U.S. Pat No. 3,250,034 an electrically operated firearm is provided with a movable firing pin. U.S. Pat. No. 3,255,547, issued June 14, 1966 to L. B. Gregory, Jr. shows an electric ignition firearm in which an electrically conductive rod is engageable with the primer of a shell or cartridge. The rod is maintained in contact with the cartridge by a spring means.

SUMMARY OF THE INVENTION

An object of the present invention is to provide a firearm system including a firearm and a shell therefor adapted to be fired electrically.

A further object of the invention is to provide an electrically fired firearm system in which the shell and firearm chamber are provided with complementary shaped interfacing surfaces to insure snug engagement between a shell electrical contact and a chamber electrical contact without use of springs or movable firing pins.

A further object of the invention is to provide such a system as is relatively non-complex and inexpensive and reliable and easy to use.

In accordance with the above and other objects, as will hereinafter appear, a feature of the present invention is the provision of a firearm system comprising a shell having a metal jacket, a rear wall portion of the jacket having a hole centrally thereof, an insulator mounted in the hole, and an electrically, conductive contact disposed axially of the insulator and the shell and spaced from the jacket in the hole, a first end of the shell contact being exposed at the rear wall and a second end of the shell contact extending inwardly of the shell and in contact with a reservoir of powder; a firearm comprising a housing having a chamber for receiving the shell, a barrel portion extending outwardly therefrom, a trigger mounted on the housing and adapted to be moved by an operator, an electrical circuit mounted in the housing and including a first contact disposed in the chamber and adapted for engagement with the shell contact, a power source disposed in the housing and in the circuit, second contact means disposed in the circuit and located proximate the trigger, and third contact means disposed in the circuit and movable by the trigger into engagement with the second contact means to close the circuit, whereby to initiate an arc between the shell contact and the metal jacket to ignite the powder.

The above and other features of the invention, including various novel details of construction and combinations of parts, will now be more particularly described with reference to the accompanying drawings and pointed out in the claims. It will be understood that the particular system embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
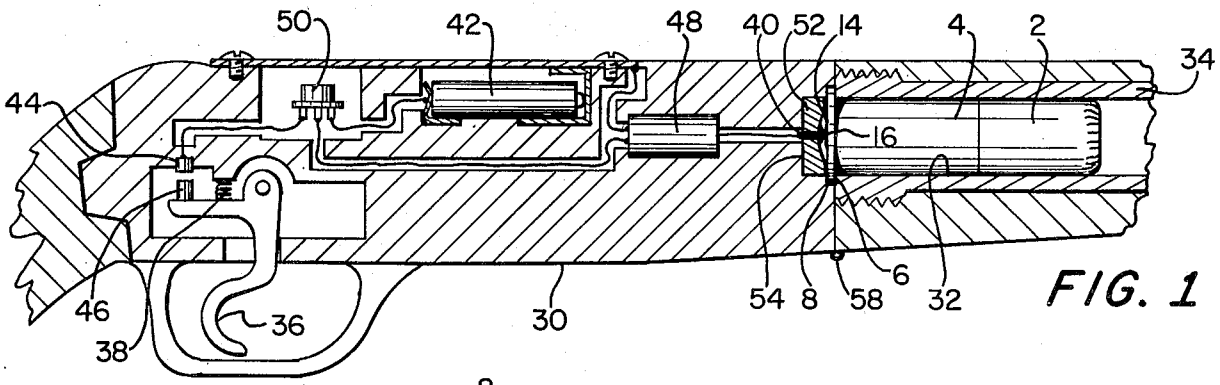
FIG. 1 is a side elevational sectional view of a firearm system illustrative of an embodiment of the invention.
Figure 3:
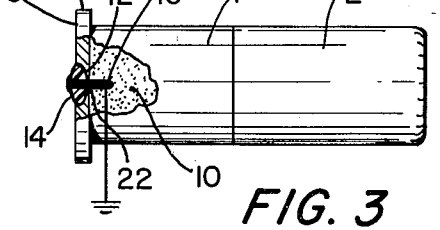
FIG. 3 is a side elevational view, partly broken away and partly in section of the shell shown in FIG. 1.

Referring to the drawings, it will be seen that the illustrative firearm system includes a shell 2 having a metal jacket 4 which, at its rearward end, is provided with a rear wall 6 having flange portions 8 extending outwardly from the shell. The shell 2 is provided with a reservoir of powder 10 in known fashion.

The rear wall 6 of the metal jacket 4 includes a hole 12 (FIG. 5) in which is disposed an insulator 14. An electrically conductive shell contact 16 is disposed axially of the insulator 14 and the shell 2 and is spaced from the walls of the hole 12. A first end 18 of the shell contact 16 is exposed at the rear wall of the shell and a second end 20 of the shell contact 16 extends inwardly of the shell and is in contact with the aforementioned powder 10. Walls 11 (FIG. 5) of the hole 12 and the second end 20 of the shell contact 16 define an annular recess 22 therebetween, the recess 22 having powder 10 therein.

The system further includes a firearm 30 (FIG. 1) comprising a housing having a chamber 32 for receiving the shell 2, and a barrel portion 34 extending outwardly therefrom. The firearm 30 is provided with a trigger 36 adapted to be moved by an operator against pressure of a spring means 38. An electrical circuit (FIG. 2) is disposed in the firearm housing and includes a first firearm contact 40 disposed in the chamber 32 and adapted for engagement with the first end 18 of the shell contact 16. A power source 42 is disposed in the housing and in the circuit. Second contact means 44 is disposed in the circuit and is located proximate the trigger 36. A third contact means 46 is disposed in the circuit and is movable by the trigger 36 into engagement with the second contact means 44 to close the circuit. Upon closure of the circuit, electrical energy from the power source 42 is conveyed to the first contact 40 which is in engagement with the shell contact 16 to initiate an arc between the second end 20 of the shell contact 16 and the walls of the hole 12 in the rear wall 6 of the metal jacket 4 of the shell 2, the arc bridging the annular recess 22.

The aforementioned circuit in the firearm housing includes a coil 48 disposed between the power source and the first contact 40.

Figure 5:
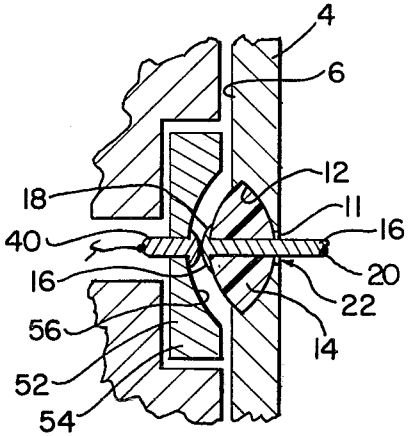
FIG. 5 is an enlarged detailed diagrammatic view of a portion of the system.
Figure 4:
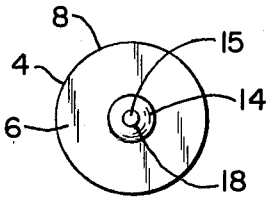
FIG. 4 is a back elevational view of the shell.

Referring particularly to FIG. 5, it will be seen that the first contact 40 is retained by an insulator means 52 which comprises a disc 54 having a concave face portion 56, the face portion 56 being adapted to receive the insulator 14 and the first end 18 of the shell contact 16 for engagement of the first contact and the shell contact.

Figure 2:
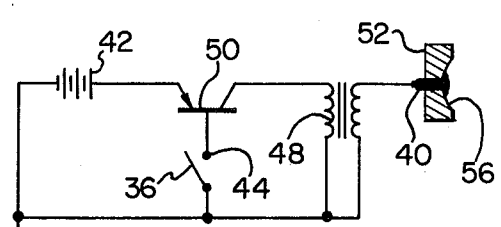
FIG. 2 is a schematic diagram of an electrical circuit suitable for the invention.

In operation, the chamber 32 is exposed, as by hinge action about a point 58, so that a shell 2 of the type above described may be inserted in the chamber 32. The firearm portions are then brought together, as shown in FIG. 1, so that the shell contact 16 is in engagement with the firearm first contact 40. An operator manipulates the trigger 36, in much the same fashion as an ordinary mechanically fired firearm, to bring the contacts 46, 44 together to close the circuit. Closure of the circuit causes an arc to bridge the recess 22 to ignite the powder therein, the ignition instantaneously extending to the remainder of the powder in the reservoir of the shell.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A firearms system comprising a shell having a metal jacket, a rear wall portion of said jacket having a hole centrally thereof, an insulator mounted in said hole, and an electrically conductive contact disposed axially of said insulator and said shell and spaced from said jacket in said hole, a first end of said shell contact being exposed at said rear wall and a second end of said shell contact extending inwardly of said shell and in contact with a reservoir of power; a firearm comprising a housing having a chamber for receiving said shell, a barrel portion extending outwardly therefrom, a trigger mounted on said housing and adapted to be moved by an operator, an electrical circuit mounted in said housing and including a first contact disposed in said chamber, insulator means disposed in said chamber, said insulator means comprising a disc having a concave face portion, said first contact being retained by said insulator disc and being exposed in said face portion, said face portion being adapted to receive said shell insulator and said shell contact for engagement of said first contact and said shell contact, a power source disposed in said housing and in said circuit, second contact means disposed in said circuit and located proximate said trigger, and third contact means disposed in said circuit and movable by said trigger into engagement with said second contact means to close said circuit, whereby to initiate an arc between said shell contact and said metal jacket to ignite said powder.

2. The invention in accordance with claim 1 in which said circuit includes a coil disposed between said power source and said first contact.

3. The invention in accordance with claim 2 in which said circuit includes a transistor in electrical communication with said power source, said second contact and said coil.

4. The invention in accordance with claim 3 including spring means for biasing said trigger to a position in which said second and third contacts are separated.

5. The invention in accordance with claim 1 in which said shell contact and said hole in said rear wall portion of said jacket define an annular recess within said shell on said rear wall portion.

6. The invention in accordance with claim 5 in which said powder is disposed in said recess.

7. The invention in accordance with claim 1 in which said shell insulator has a convex surface engageable with said concave face portion of said chamber insulator.

* * * * *